US008110233B2

(12) United States Patent
Beavers Blanks et al.

(10) Patent No.: US 8,110,233 B2
(45) Date of Patent: Feb. 7, 2012

(54) METHOD OF DISPENSING A SOLID PRODUCT

(75) Inventors: Amie L Beavers Blanks, Clemmons, NC (US); Kristine Jeanette Williams, Oak Ridge, NC (US); Nicole M Balamucki, Greensboro, NC (US)

(73) Assignee: Ecolab USA Inc., St. Paul, MN (US)

( * ) Notice: Subject to any disclaimer, the term of this patent is extended or adjusted under 35 U.S.C. 154(b) by 968 days.

(21) Appl. No.: 11/487,166

(22) Filed: Jul. 14, 2006

(65) Prior Publication Data

US 2008/0011767 A1 Jan. 17, 2008

(51) Int. Cl.

| | |
|---|---|
| ***A61L 2/00*** | (2006.01) |
| ***B65D 85/00*** | (2006.01) |
| ***B65D 25/08*** | (2006.01) |
| ***B65D 37/00*** | (2006.01) |
| ***G01F 11/28*** | (2006.01) |
| ***B67D 3/00*** | (2006.01) |
| ***A21D 13/00*** | (2006.01) |
| ***B65B 55/00*** | (2006.01) |
| ***A23P 1/00*** | (2006.01) |

(52) U.S. Cl. ..... 426/394; 422/1; 422/25; 422/302; 422/303; 206/0.5; 206/219; 222/465.1; 222/542; 222/92; 222/210; 222/441; 426/138; 426/395; 99/646 C

(58) Field of Classification Search ..... 422/1, 25, 422/302, 303; 206/0.5, 219; 222/465.1, 222/542, 92, 210, 323, 441; 426/138, 394, 426/395; 99/646 C See application file for complete search history.

(56) References Cited

U.S. PATENT DOCUMENTS

| | | | | |
|---|---|---|---|---|
| 2,920,417 | A * | 1/1960 | Wertheimer | 510/439 |
| RE32,763 | E | 10/1988 | Fernholtz et al. | |
| 4,994,278 | A * | 2/1991 | Sablotsky et al. | 424/449 |
| 5,474,698 | A | 12/1995 | Rolando et al. | |
| 5,797,986 | A | 8/1998 | Rolando et al. | |
| 6,370,813 | B1 | 4/2002 | Nelson et al. | |
| 6,432,906 | B1 | 8/2002 | Carlson et al. | |
| 6,679,402 | B1 * | 1/2004 | D'Alayer De Costemore D'Arc | 222/413 |

(Continued)

FOREIGN PATENT DOCUMENTS

| | | |
|---|---|---|
| DE | 296 18 751 U1 | 2/1997 |
| EP | 0 533 238 B1 | 4/1996 |
| EP | 1 454 842 A1 | 9/2004 |

(Continued)

OTHER PUBLICATIONS

English Translation for JP 2003-182716 from the Japensee Patent Office.*

*Primary Examiner* — Jill Warden
*Assistant Examiner* — Monzer Chorbaji
(74) *Attorney, Agent, or Firm* — IPLM Group, P.A.

(57) ABSTRACT

A product packaging for a solid product comprises a base, a lid, and a seal. The base has a top, sides, and a bottom forming a cavity configured and arranged to receive a solid product, and the base has an exterior surface. A texture is on the exterior surface of the base, whereby the texture enhances a user's ability to grip the base when the base is inverted. The seal interconnects the top of the base and the lid and allows the lid to be peeled away from the top of the base.

11 Claims, 11 Drawing Sheets

U.S. PATENT DOCUMENTS

| | | | | |
|---|---|---|---|---|
| 6,996,869 | B2 | 2/2006 | Lancette | |
| 2004/0226990 | A1 * | 11/2004 | Williams et al. | 229/123.1 |
| 2005/0197276 | A1 | 9/2005 | Rigley et al. | |
| 2006/0024492 | A1 | 2/2006 | Walz et al. | |

FOREIGN PATENT DOCUMENTS

| | | | |
|---|---|---|---|
| JP | 2003-182716 | * | 7/2003 |
| JP | 2003182716 A | | 7/2003 |
| WO | WO 96/41565 | | 12/1996 |

* cited by examiner

FIG. 2
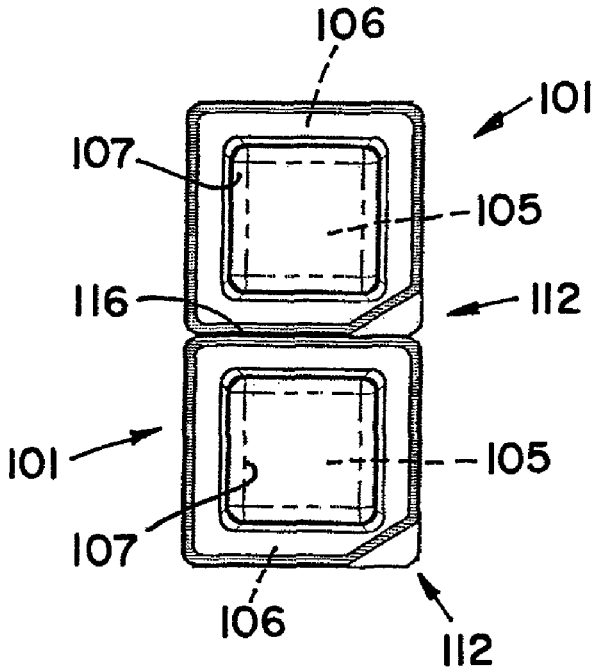
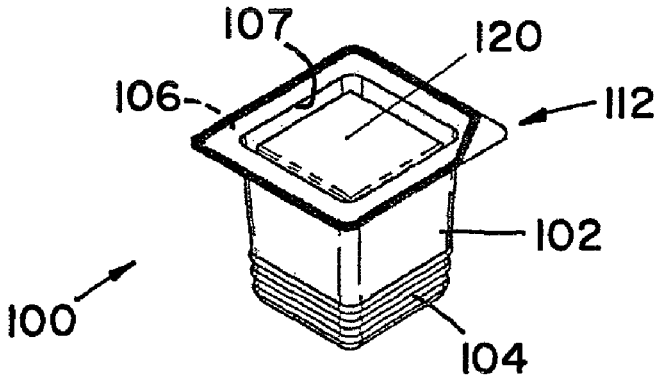
FIG. 1

FIG. 3
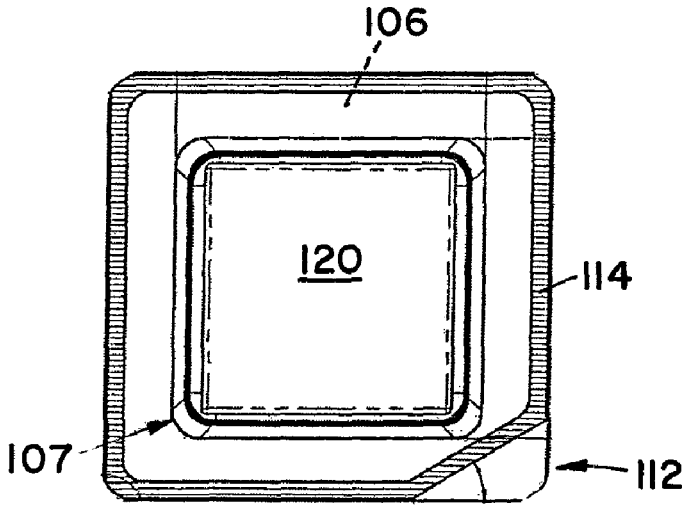
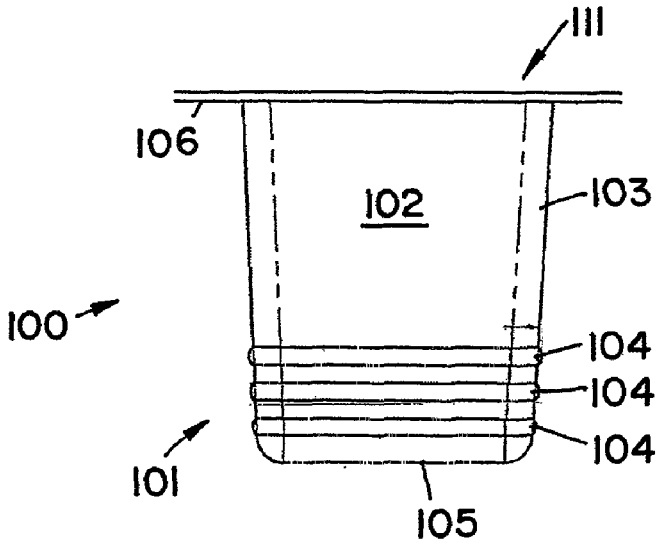
FIG. 4

FIG.6
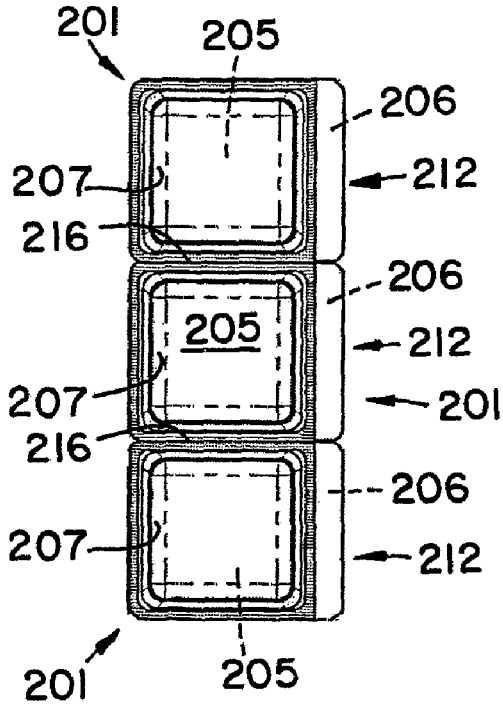
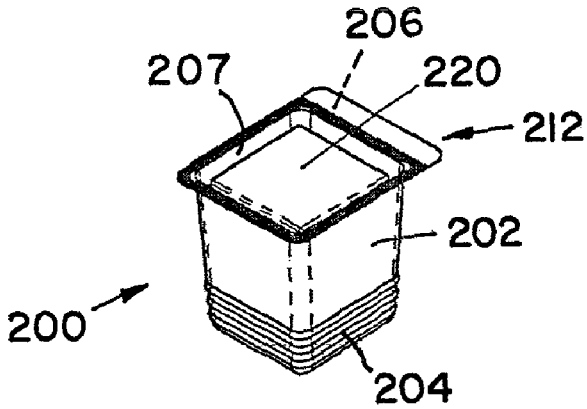
FIG. 5

FIG. 7
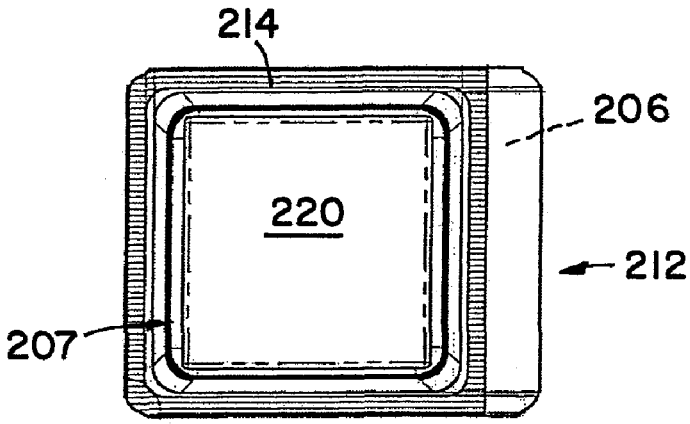
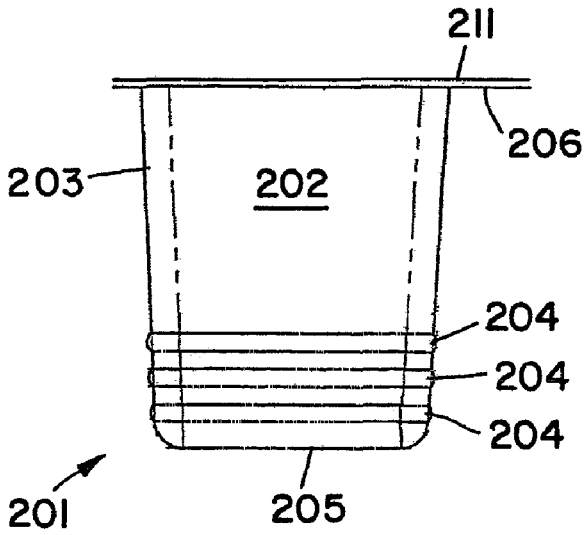
FIG. 8

FIG.10
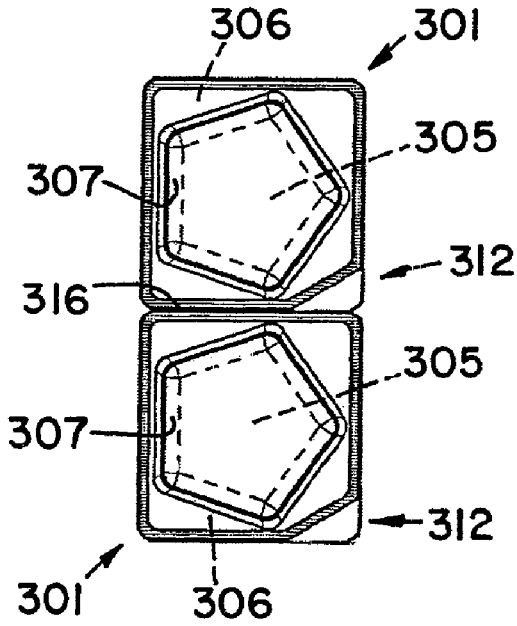
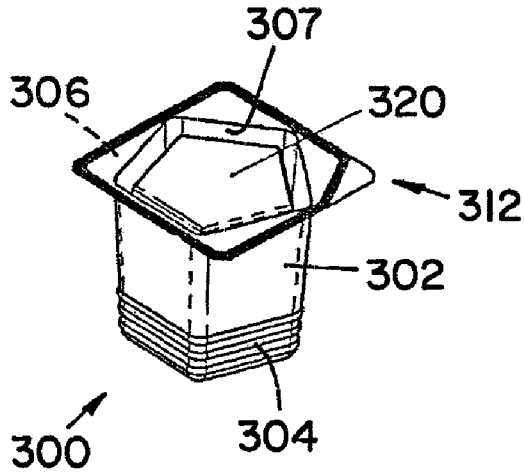
FIG. 9

FIG.11
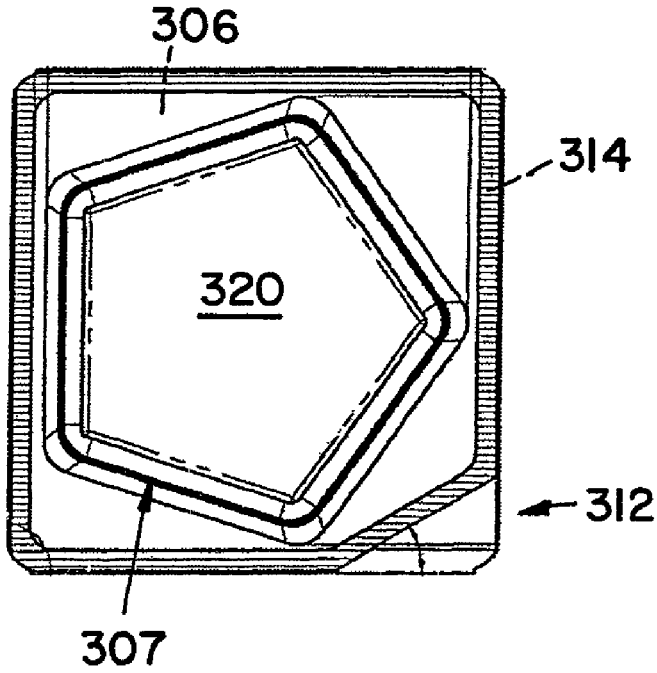
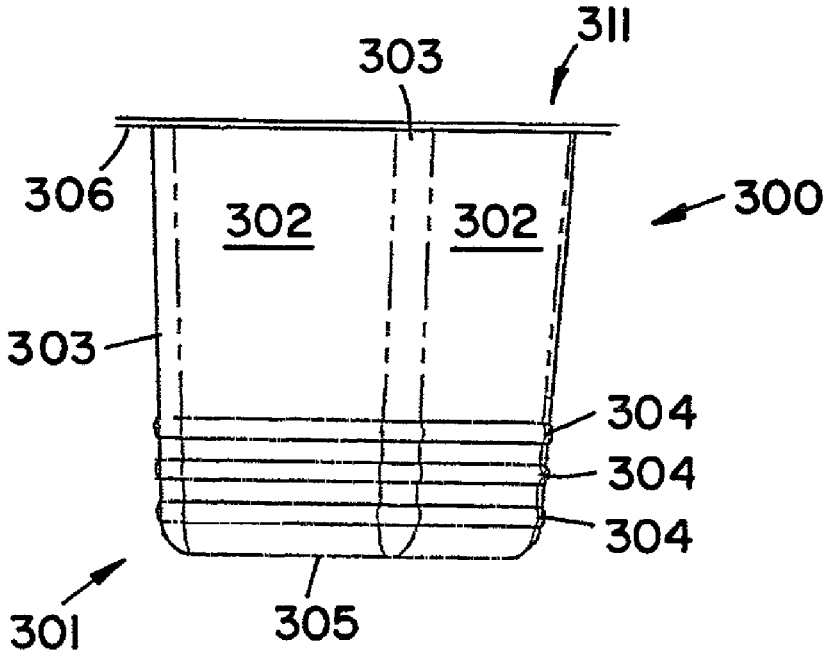
FIG.12

FIG.14
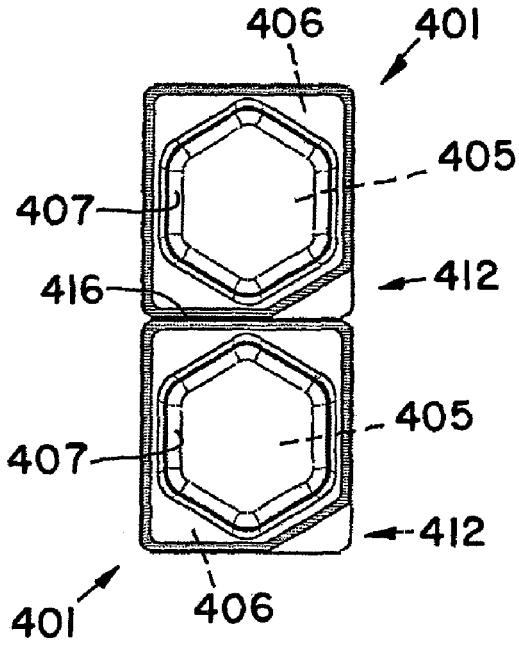
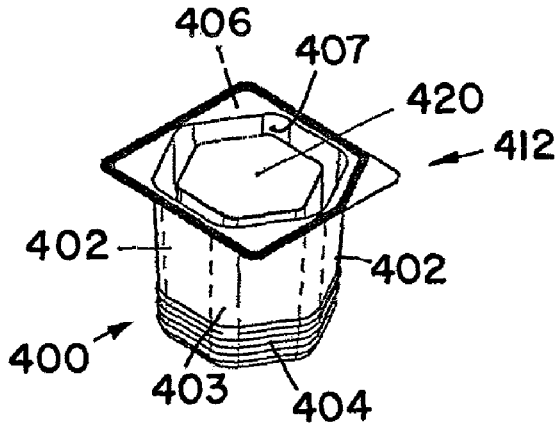
FIG. 13

FIG. 15
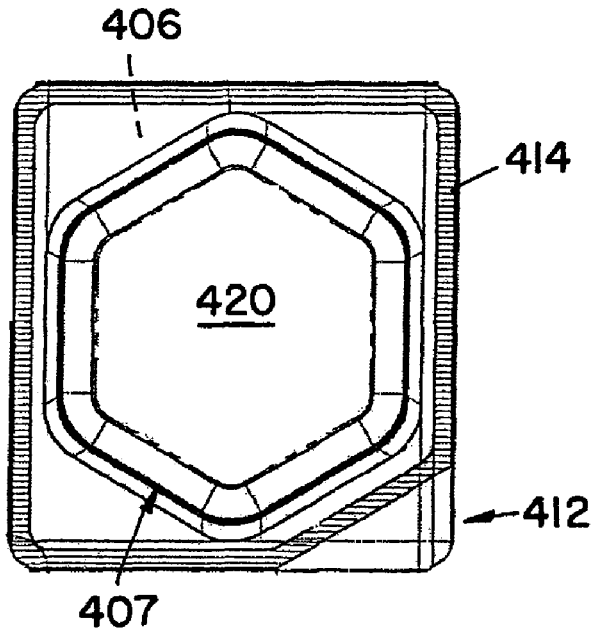
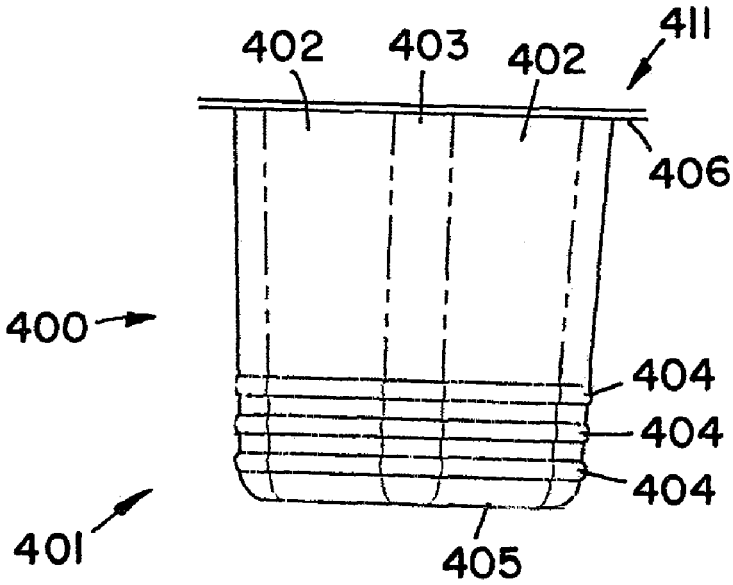
FIG. 16

METHOD OF DISPENSING A SOLID PRODUCT

FIELD OF THE INVENTION

The present invention relates to product packaging for solid products.

BACKGROUND OF THE INVENTION

Solid products provide many advantages over using non-solid products. For example, solid products are typically less expensive to ship because they are usually formulated as concentrates that are then diluted prior to use. Solid products can be formulated using aggressive chemistry that provides better cleaning including strong acids and strong bases. Solid products with such aggressive chemistry are generally considered safer than comparable non-solid or liquid products because solid products cannot spill like non-solid or liquid products.

Solid products are dispensed in solid product dispensers to create a concentrated use solution or a use solution. Some solid products are caustic or corrosive and should not be handled by coming into direct-contact with the solid products. This is particularly true in industrial laundry, warewashing, and floor care products.

Thermoformed blister packs and packages with lids are commonly used to package solid products. However, these types of packages typically require the user to remove the backs or the lids from the packages and drop the solid products into the dispensers. This technique exposes the user to contact the solid products directly, which is not desirable.

Another type of packaging in which solid products are packaged is shrink wrapped films. Small holes in the film allow the evacuation of otherwise trapped air as the film shrinks to conform to the shape of the solid product. These small holes allow moisture from the atmosphere to enter the package, which may cause the solid product to swell and at least partially dissolve. Further, the user may directly contact the solid product that has escaped through these small holes. Thus, it is challenging to load solid products into dispensers without touching the solid products.

One problem related to the manufacture, storage, and use of solid products including extruded acidic and alkaline solid products is the stability of the solid products. Upon exposure to environmental conditions such as humidity, the solid products can absorb humidity resulting in a softening or dissolution of at least a portion of the solid products. The absorption of humidity can result in softened layers of the solid products rendering the solid products difficult to handle and properly dispense. Further, in conditions of higher humidity or higher concentrations of alkalinity, the absorption of humidity can result in the creation of a liquid product that can slump or flow from the surface of the solid product creating a pool of highly caustic material. Not only is the humidity and stability of the solid products a problem in manufacturing and handling of the products, the instability can also cause problems in dispensing of the products. The softened surface or liquid material that can flow from the surface can cause spikes of material during dispensing resulting in uneven concentrations being dispensed. When dispensed using spray-type dispensers, a spray of water is directed onto a surface of the solid product. When operating properly, the spray removes a small portion of the solid product in the form of an aqueous concentrate use solution. If the solid product is at least partially softened or liquefied, the aqueous concentrate use solution will be too concentrated.

It is desired to have a solid product packaging that assists in the loading of the solid products into dispensers without directly contacting the solid products and that assists in keeping the solid products stable during storage of the solid products.

SUMMARY OF THE INVENTION

One aspect of the present invention provides a product packaging for a solid product comprising a base, a lid, and a seal. The base has a top, sides, and a bottom forming a cavity configured and arranged to receive a solid product, and the base has an exterior surface. A texture is on the exterior surface of the base, whereby the texture enhances a user's ability to grip the base when the base is inverted. The seal interconnects the top of the base and the lid and allows the lid to be peeled away from the top of the base.

Another aspect of the present invention provides a method of dispensing a solid product from a product packaging into a solid product dispenser. A product packaging having a base, a lid, and a seal is obtained. The base has a top, sides, and a bottom forming a cavity configured and arranged to receive the solid product. The seal interconnects the top of the base and the lid and allows the lid to be grasped and peeled to separate the lid from the top of the base. A portion of the peelable lid is grasped, and the peelable lid is peeled away from the base. The base is held and inverted so that the bottom of the base is in an upward orientation and the top of the base is in a downward orientation. The solid product is allowed to slide out of the cavity into the solid product dispenser.

Another aspect of the present invention provides a method of dispensing a solid product from a product packaging into a solid product dispenser. The product packaging has a base, a lid, and a seal. The base has a top, sides, and a bottom forming a cavity configured and arranged to receive the solid product, and the base has an exterior surface with a texture on at least a portion of the exterior surface. The seal interconnects the top of the base and the lid and allows the lid to be grasped and peeled to separate the lid from the top of the base. The product packaging is obtained. A portion of the peelable lid is grasped and the peelable lid is peeled away from the base. The base is held proximate the texture, which provides a grippable surface proximate the exterior surface of the base. The base is squeezed proximate the texture thus deflecting the base inward to provide friction between the base and the solid product prior to inverting the base so that the solid product does not fall out of the base until the friction is released. The base is inverted so that the bottom of the base is in an upward orientation and the top of the base is in a downward orientation, and the texture enhances a user's ability to grip the base when the base is inverted. The friction is released thereby allowing the solid product to slide out of the cavity into the solid product dispenser.

BRIEF DESCRIPTION OF THE DRAWINGS

FIG. 1 is a perspective view of a product packaging constructed according to the principles of the present invention with a solid product therein;

FIG. 2 is a top view of the product packing shown in FIG. 1 as the product packaging is manufactured;

FIG. 3 is a top view of the product packaging shown in FIG. 1 with a solid product therein;

FIG. 4 is a side view of the product packaging shown in FIG. 1;

FIG. 5 is a perspective view of another product packaging constructed according to the principles of the present invention with a solid product therein;

FIG. 6 is a top view of the product packing shown in FIG. 5 as the product packaging is manufactured;

FIG. 7 is a top view of the product packaging shown in FIG. 5 with a solid product therein;

FIG. 8 is a side view of the product packaging shown in FIG. 5;

FIG. 9 is a perspective view of another product packaging constructed according to the principles of the present invention with a solid product therein;

FIG. 10 is a top view of the product packing shown in FIG. 9 as the product packaging is manufactured;

FIG. 11 is a top view of the product packaging shown in FIG. 9 with a solid product therein;

FIG. 12 is a side view of the product packaging shown in FIG. 9;

FIG. 13 is a perspective view of another product packaging constructed according to the principles of the present invention with a solid product therein;

FIG. 14 is a top view of the product packing shown in FIG. 13 as the product packaging is manufactured;

FIG. 15 is a top view of the product packaging shown in FIG. 13 with a solid product therein;

FIG. 16 is a side view of the product packaging shown in FIG. 13;

DETAILED DESCRIPTION OF A PREFERRED EMBODIMENT

Figure 17:
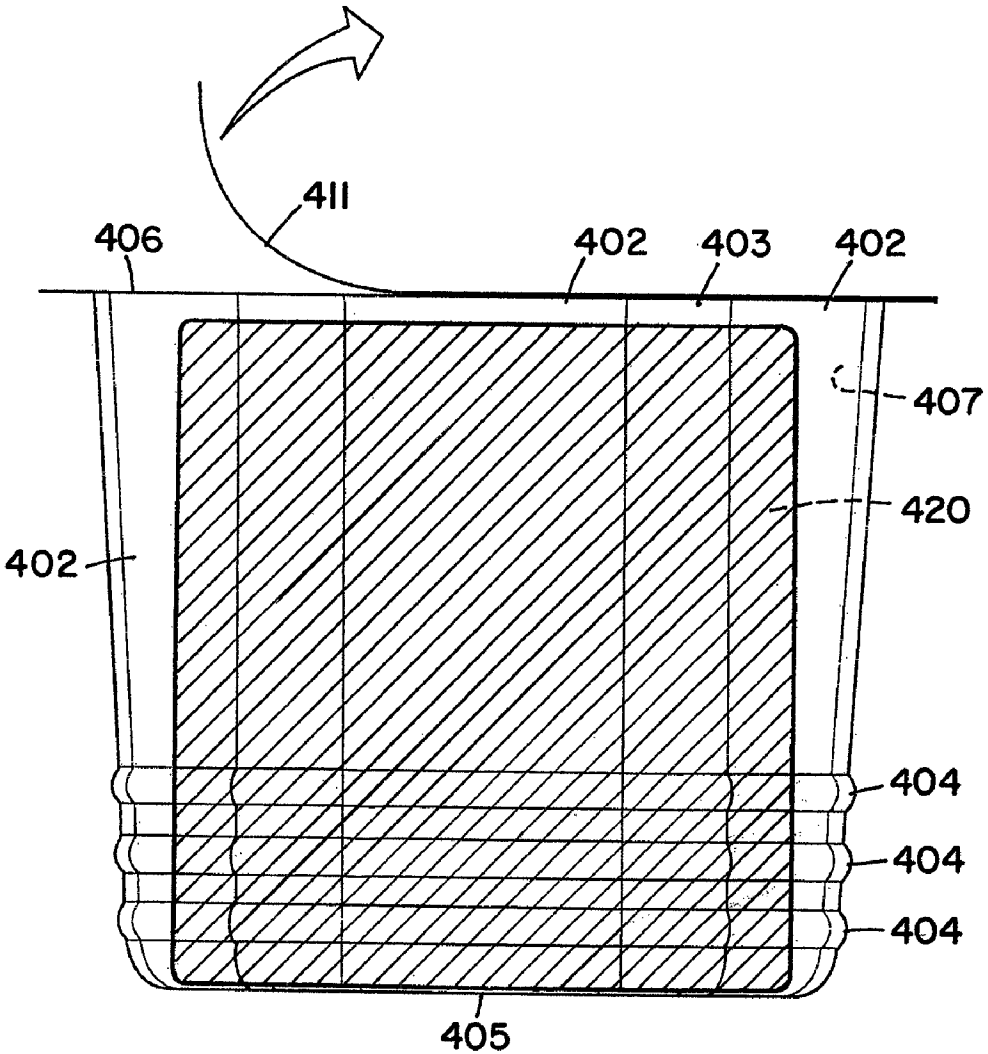
FIG. 17 is a side view of the product packaging shown in FIG. 13 with a lid partially peeled away from a base of the product packaging.

A preferred embodiment solid product packaging is designated by the numeral 100 in FIGS. 1-4, a preferred embodiment solid product packaging is designated by the number 200 in FIGS. 5-8, a preferred embodiment solid product packaging is designated by the number 300 in FIGS. 9-12, and a preferred embodiment solid product packaging is designated by the number 400 in FIGS. 13-18.

The present invention may be used with any solid product. It is understood that the phrase "solid product" includes solid products, substantially solid products, semi-solid products, and the like. If the solid product is in a shaped form, such as a block, the solid product may be formed in any desired manner including cast methods, extrusion, and pressed powder. The solid product may be formulated for a variety of uses such as, but limited to, a warewashing detergent, a warewashing rinse aid, a vehicle care detergent such as in a car wash, a medical instrument detergent, a clean-in-place cleaner, a floor cleaner, and the like. The solid product may include a variety of different chemistries including acids, bases, hardening agents, sequestering agents, surfactants, builders, enzymes, dyes, fragrances, and the like.

As shown in FIGS. 1-4, the product packaging 100 includes a base 101 and a peelable lid 111 interconnected by a seal 114. The base 101 includes four sides 102, the adjacent sides 102 being interconnected by a rounded corner 103. Each side 102 is preferably approximately 90 degrees from the adjacent side 102. The sides 102 and the corners 103 are interconnected proximate the bottom edges of the sides 102 and the corners 103 by a bottom 105. A top 106, which is preferably a flange, extends outward from the sides 102 and the corners 103 proximate the top edges of the sides 102 and the corners 103. The sides 102, the corners 103, and the bottom 105 form a cavity 107. Ribbing 104 is proximate the bottom 105 of the base 101 and is a textured, non-slip, grippable surface on the exterior of the base 101. It is recognized that other textured, non-slip, grippable surfaces such as, but not limited to, waffle weaves, bumps, roughened surfaces, and rubber coated surfaces may be used. The ribbing 104 is preferably at least one ridge extending outward from at least two opposing sides 102 and, more preferably, at least three ridges extending outward from the sides 102 and the corners 105 around the base 101 parallel with the bottom 105. The ribbing 104 preferably extends outward from the base 101 at least 1.5 millimeters ("mm"), and if multiple ridges are used, the ridges are preferably spaced apart at least 25.4 mm center to center of the ridges. The ribbing 104 is preferably within 2.0 inches from the bottom 105.

Although it is recognized that the base 101 may be made of separate components, the base 101 is preferably integrally formed, including the ribbing 104 extending outward from the sides 102 and the corners 103. Preferably, the base 101 is thermoformed by means well known in the art and made of polymeric (relating to or comprised of polymers) materials including, but not limited to, polyethylenes, nylons, polypropylene, polystyrene, and polyvinyl chloride. As shown in FIG. 2, the base 101 may be constructed by means well known in the art adjacent another base 101 with a score line 116 between the bases 101 so that the bases 101 may be easily separated. A solid product 120 is placed within the cavity 107. Preferably, the solid product 120 is a square-shaped product corresponding with the shape of the base 101. Then, the peelable lid 111 is connected to the top 106 of the base 101.

The peelable lid 111 is preferably an easy peel film corresponding in shape with the top 106 of the base 101. Preferably, the lid 111 is made of a multi-layer laminate comprising at least two layers, one of which is a heat sealable layer. The seal 114, which is preferably formed by applying heat to the lid 111 which bonds the heat sealable layer to the top 106 of the base 101, interconnects the top 106 and the lid 111. The seal 114 is preferably placed proximate the perimeter of the top 106 with one corner angled so that there is a corner where the lid 111 is not connected to the top 106 thus providing a grasping portion 112 where the lid 111 can easily be grasped by the user to begin peeling the lid 111 away from the top 106. The peel strength of the seal 114 is preferably less than 250 grams per inch, which allows for easy peeling of the lid 111 away from the top 106 while providing a seal between the top 106 and the lid 11. The base 101, the lid 111, and the seal 114 provide a moisture barrier so that moisture cannot penetrate the product packaging 100. The water vapor transmission rate ("WVTR") is measured in grams per 100 square inches per 24 hours (g/100 sq. in.). For moisture sensitive products, the WVTR is preferably less than 0.02 g/100 sq. in. for the base 101 and less than 0.13 g/100 sq. in. for the lid 111.

As shown in FIGS. 5-8, the product packaging 200 includes a base 201 and a peelable lid 211 interconnected by a seal 214. The base 201 includes four sides 202, the adjacent sides 202 being interconnected by a rounded corner 203. Each side 202 is preferably approximately 90 degrees from the adjacent side 202. The sides 202 and the corners 203 are interconnected proximate the bottom edges of the sides 202 and the corners 203 by a bottom 205. A top 206, which is preferably a flange, extends outward from the sides 202 and the corners 203 proximate the top edges of the sides 202 and the corners 203. The sides 202, the corners 203, and the bottom 205 form a cavity 207. Ribbing 204 is proximate the bottom 205 of the base 201 and is a textured, non-slip, grippable surface on the exterior of the base 201. It is recognized that other textured, non-slip, grippable surfaces such as, but not limited to, waffle weaves, bumps, roughened surfaces, and rubber coated surfaces may be used. The ribbing 204 is preferably at least one ridge extending outward from at least two opposing sides 202 and, more preferably, at least three ridges extending outward from the sides 202 and the corners 205 around the base 201 parallel with the bottom 205. The ribbing 204 preferably extends outward from the base 201 at least 1.5 millimeters ("mm"), and if multiple ridges are used, the ridges are preferably spaced apart at least 25.4 mm center to center of the ridges. The ribbing 204 is preferably within 2.0 inches from the bottom 205.

Although it is recognized that the base 201 may be made of separate components, the base 201 is preferably integrally formed, including the ribbing 204 extending outward from the sides 202 and the corners 203. Preferably, the base 201 is thermoformed by means well known in the art and made of polymeric (relating to or comprised of polymers) materials including, but not limited to, polyethylenes, nylons, polypropylene, polystyrene, and polyvinyl chloride. As shown in FIG. 6, the base 201 may be constructed by means well known in the art adjacent another base 201 on each side with score lines 216 between the bases 201 so that the bases 201 may be easily separated. A solid product 220 is placed within the cavity 207. Preferably, the solid product 220 is a square-shaped product corresponding with the shape of the base 201. Then, the peelable lid 211 is connected to the top 206 of the base 201.

The peelable lid 211 is preferably an easy peel film corresponding in shape with the top 206 of the base 201. Preferably, the lid 211 is made of a multi-layer laminate comprising at least two layers, one of which is a heat sealable layer. The seal 214, which is preferably formed by applying heat to the lid 211 which bonds the heat sealable layer to the top 206 of the base 201, interconnects the top 206 and the lid 211. The seal 214 is preferably placed proximate the perimeter of three sides of the top 206 with the fourth side more proximate the cavity 207 so that there is a side edge where the lid 211 is not connected to the top 206 thus providing a grasping portion 212 where the lid 211 can easily be grasped by the user to begin peeling the lid 211 away from the top 206. The peel strength of the seal 214 is preferably less than 250 grams per inch, which allows for easy peeling of the lid 211 away from the top 206 while providing a seal between the top 206 and the lid 211. The base 201, the lid 211, and the seal 214 provide a moisture barrier so that moisture cannot penetrate the product packaging 200. The water vapor transmission rate ("WVTR") is measured in grams per 100 square inches per 24 hours (g/100 sq. in.). For moisture sensitive products, the WVTR is preferably less than 0.02 g/100 sq. in. for the base 201 and less than 0.13 g/100 sq. in. for the lid 211.

As shown in FIGS. 9-12, the product packaging 300 includes a base 301 and a peelable lid 311 interconnected by a seal 314. The base 301 includes five sides 302, the adjacent sides 302 being interconnected by a rounded corner 303. Each side 302 is preferably approximately 108 degrees from the adjacent side 302. The sides 302 and the corners 303 are interconnected proximate the bottom edges of the sides 302 and the corners 303 by a bottom 305. A top 306, which is preferably a flange, extends outward from the sides 302 and the corners 303 proximate the top edges of the sides 302 and the corners 303. The sides 302, the corners 303, and the bottom 305 form a cavity 307. Ribbing 304 is proximate the bottom 305 of the base 301 and is a textured, non-slip, grippable surface on the exterior of the base 301. It is recognized that other textured, non-slip, grippable surfaces such as, but not limited to, waffle weaves, bumps, roughened surfaces, and rubber coated surfaces may be used. The ribbing 304 is preferably at least one ridge extending outward from at least two opposing sides 302 and, more preferably, at least three ridges extending outward from the sides 302 and the corners 305 around the base 301 parallel with the bottom 305. The ribbing 304 preferably extends outward from the base 301 at least 1.5 millimeters ("mm"), and if multiple ridges are used, the ridges are preferably spaced apart at least 25.4 mm center to center of the ridges. The ribbing 304 is preferably within 2.0 inches from the bottom 305.

Although it is recognized that the base 301 may be made of separate components, the base 301 is preferably integrally formed, including the ribbing 304 extending outward from the sides 302 and the corners 303. Preferably, the base 301 is thermoformed by means well known in the art and made of polymeric (relating to or comprised of polymers) materials including, but not limited to, polyethylenes, nylons, polypropylene, polystyrene, and polyvinyl chloride. As shown in FIG. 10, the base 301 may be constructed by means well known in the art adjacent another base 301 with a score line 316 between the bases 301 so that the bases 301 may be easily separated. A solid product 320 is placed within the cavity 307. Preferably, the solid product 320 is a pentagon-shaped product corresponding with the shape of the base 301. Then, the peelable lid 311 is connected to the top 306 of the base 301.

The peelable lid 311 is preferably an easy peel film corresponding in shape with the top 306 of the base 301. Preferably, the lid 311 is made of a multi-layer laminate comprising at least two layers, one of which is a heat sealable layer. The seal 314, which is preferably formed by applying heat to the lid 311 which bonds the heat sealable layer to the top 306 of the base 301, interconnects the top 306 and the lid 311. The seal 314 is preferably placed proximate the perimeter of the top 306 with one corner angled so that there is a corner where the lid 311 is not connected to the top 306 thus providing a grasping portion 312 where the lid 311 can easily be grasped by the user to begin peeling the lid 311 away from the top 306. The peel strength of the seal 314 is preferably less than 250 grams per inch, which allows for easy peeling of the lid 311 away from the top 306 while providing a seal between the top 306 and the lid 311. The base 301, the lid 311, and the seal 314 provide a moisture barrier so that moisture cannot penetrate the product packaging 300. The water vapor transmission rate ("WVTR") is measured in grams per 100 square inches per 24 hours (g/100 sq. in.). For moisture sensitive products, the WVTR is preferably less than 0.02 g/100 sq. in. for the base 301 and less than 0.13 g/100 sq. in. for the lid 311.

As shown in FIGS. 13-17, the product packaging 400 includes a base 401 and a peelable lid 411 interconnected by a seal 414. The base 401 includes six sides 402, the adjacent sides 402 being interconnected by a rounded corner 403. Each side 402 is preferably approximately 120 degrees from the adjacent side 402. The sides 402 and the corners 403 are interconnected proximate the bottom edges of the sides 402 and the corners 403 by a bottom 405. A top 406, which is preferably a flange, extends outward from the sides 402 and the corners 403 proximate the top edges of the sides 402 and the corners 403. The sides 402, the corners 403, and the bottom 405 form a cavity 407. Ribbing 404 is proximate the bottom 405 of the base 401 and is a textured, non-slip, grippable surface on the exterior of the base 401. It is recognized that other textured, non-slip, grippable surfaces such as, but not limited to, waffle weaves, bumps, roughened surfaces, and rubber coated surfaces may be used. The ribbing 404 is preferably at least one ridge extending outward from at least two opposing sides 402 and, more preferably, at least three ridges extending outward from the sides 402 and the corners 405 around the base 401 parallel with the bottom 405. The ribbing 404 preferably extends outward from the base 401 at least 1.5 millimeters ("mm"), and if multiple ridges are used, the ridges are preferably spaced apart at least 25.4 mm center to center of the ridges. The ribbing 404 is preferably within 2.0 inches from the bottom 405.

Although it is recognized that the base 401 may be made of separate components, the base 401 is preferably integrally formed, including the ribbing 404 extending outward from the sides 402 and the corners 403. Preferably, the base 401 is thermoformed by means well known in the art and made of polymeric (relating to or comprised of polymers) materials including, but not limited to, polyethylenes, nylons, polypropylene, polystyrene, and polyvinyl chloride. As shown in FIG. 14, the base 401 may be constructed by means well known in the art adjacent another base 401 with a score line 416 between the bases 401 so that the bases 401 may be easily separated. A solid product 420 is placed within the cavity 407. Preferably, the solid product 420 is a hexagon-shaped product corresponding with the shape of the base 401. Then, the peelable lid 411 is connected to the top 406 of the base 401.

The peelable lid 411 is preferably an easy peel film corresponding in shape with the top 406 of the base 401. Preferably, the lid 411 is made of a multi-layer laminate comprising at least two layers, one of which is a heat sealable layer. The seal 414, which is preferably formed by applying heat to the lid 411 which bonds the heat sealable layer to the top 406 of the base 401, interconnects the top 406 and the lid 411. The seal 414 is preferably placed proximate the perimeter of the top 406 with one corner angled so that there is a corner where the lid 411 is not connected to the top 406 thus providing a grasping portion 412 where the lid 411 can easily be grasped by the user to begin peeling the lid 411 away from the top 406. The peel strength of the seal 414 is preferably less than 250 grams per inch, which allows for easy peeling of the lid 411 away from the top 406 while providing a seal between the top 406 and the lid 411. The base 401, the lid 411; and the seal 414 provide a moisture barrier so that moisture cannot penetrate the product packaging 400. The water vapor transmission rate ("WVTR") is measured in grams per 100 square inches per 24 hours (g/100 sq. in.). For moisture sensitive products, the WVTR is preferably less than 0.02 g/100 sq. in. for the base 401 and less than 0.13 g/100 sq. in. for the lid 411.

The product packages 100, 200, 300, and 400 allow for the solid products 120, 220, 320, and 420, respectively, contained therein to be easily placed into a solid product dispenser without directly contacting the solid products 120, 220, 320, and 420. Although specific shapes of the bases and of the products are shown and described, it is recognized that other shapes of the bases and of the products may be used. Preferably, the shape of the base corresponds with the shape of the product. For ease of reference, how the product packaging 400 is used to place the product 420 into a solid product dispenser is described, although this description is also applicable to other embodiments.

Figure 18:
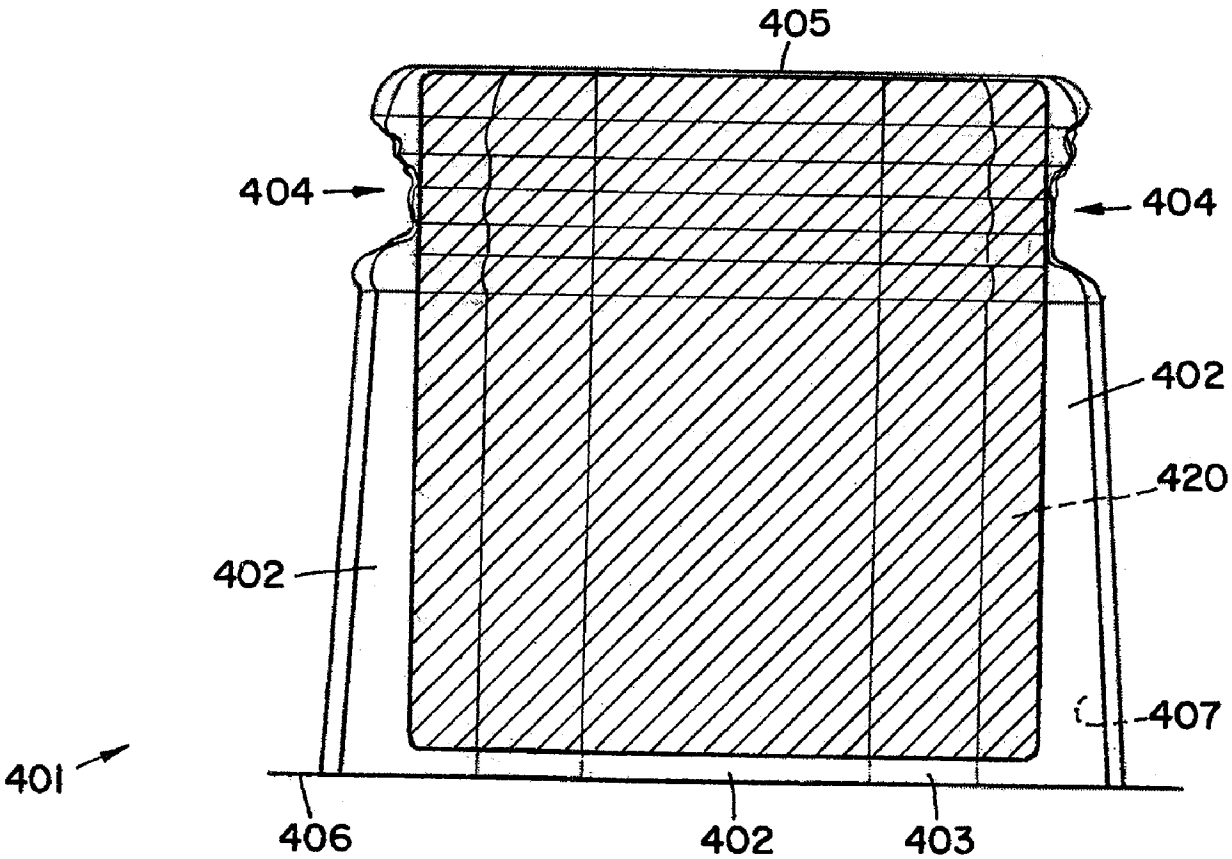
FIG. 18 is a side view of the product packaging shown in FIG. 17 inverted with a portion of the base deflected inward to assist in holding the product within the base.

In operation, the user preferably holds the product package 400 in one hand and grasps the lid 411 proximate the grasping portion 412 with the other hand and begins to peel the lid 411 away from the top 406 by breaking the seal 414, as illustrated in FIG. 17. Preferably, a tool is not needed to remove the lid 411. Once the lid 411 has been peeled away from the top 406, thus exposing the solid product 420 within the cavity 407, the user preferably squeezes the base 401 thus deflecting the base 401 proximate the ribbing 404 inward to provide friction between the base 401 and the solid product 420, as shown in FIG. 18, so that the solid product 420 does not fall out of the base 401 when the base 401 is inverted until it is positioned above the product housing and the user releases his or her grip on the base 401. The user then inverts the base 401, the ribbing 404 providing a non-slip, grippable surface, and releases his or her grip on the base 401 thus releasing the friction between the base 401 and the solid product 420, which allows the solid product 420 to fall out of the cavity 407 and into the product housing of the solid product dispenser. Thus, no direct contact with the solid product 420 is necessary.

Some solid products, such as solid acidic and alkaline products, are susceptible to moisture gain, which has a detrimental effect on the product appearance, ease of handling, and product performance. Examples of acidic solid products are disclosed in U.S. Pat. No. 6,432,906 and U.S. Patent Application Publication No. US 2005/0197276 A1, which are incorporated by reference herein. Examples of alkaline solid products are disclosed in U.S. Pat. No. 5,474,698 and U.S. patent application Ser. No. 11/487,599, titled Alkaline Floor Cleaning Composition and Method of Cleaning a Floor, which are incorporated by reference herein. The acidic solid product disclosed in U.S. Patent Application Publication No. US 2005/0197276 A1 and the alkaline solid product disclosed in U.S. patent application Ser. No. 11/487,599, titled Alkaline Floor Cleaning Composition and Method of Cleaning a Floor are the SOLIDSENSE™ Floor Care A & B products by Ecolab Inc, of St. Paul, Minn.

Thus, the types of materials used for the product packaging is important to ensure the stability of certain types of solid products. As stated previously, for moisture sensitive products, the WVTR is preferably less than 0.02 g/100 sq. in. for the base and less than 0.13 g/100 sq. in. for the lid. Several materials were tested to determine which materials were most desirable in keeping solid products stable.

EXAMPLE 1

Testing was conducted to determine weight loss and weight gain in an acid product, as disclosed in U.S. Patent Application Publication No. US 2005/0197276 A1 and the acid product of the SOLIDSENSE™ Floor Care A & B products by Ecolab Inc. of St. Paul, Minn., over a period of eight weeks when exposed to accelerated conditions (100° F. with a relative humidity of 90%) in three different types of product packaging.

Product packaging 1 was a flexible film, an oriented polypropylene pouch (WLP-2202 manufactured by WIN-PAK LTD. of Winnipeg, Manitoba, Canada) heat sealed to contain the solid product therein.

Product Packaging 2 was a rigid polypropylene tray manufactured by Creative Forming, Inc. of Ripon, Wis. with a film lid (ESE 1250 Z1 film manufactured by Creative Forming, Inc. of Ripon, Wis.) heat sealed onto the tray to contain the solid product therein.

Product Packaging 3 was a rigid recycled polyethylene terephthalate (RPET) tray manufactured by Creative Forming, Inc. of Ripon, Wis. with a film lid (ES3 50 N film manufactured by Creative Forming, Inc. of Ripon, Wis.) heat sealed onto the tray to contain the solid product therein.

Table 1 shows the percentage of weight gain over eight weeks when the solid products were exposed to accelerated conditions (100° F. with a relative humidity of 90%) in the three different types of product packaging.

TABLE 1

| Percentage of Weight Gain Over Eight Weeks | | | | | | | | |
|---|---|---|---|---|---|---|---|---|
| Packaging | Week 1 | Week 2 | Week 3 | Week 4 | Week 5 | Week 6 | Week 7 | Week 8 |
| 1 | 0.26 | 0.49 | 0.75 | 0.97 | 1.16 | 1.38 | 1.58 | 1.77 |
| 2 | 0.15 | 0.35 | 0.59 | 0.75 | 0.96 | 1.15 | 1.34 | 1.51 |
| 3 | 0.54 | 0.98 | 1.41 | 1.79 | 2.14 | 2.50 | 2.79 | 3.08 |

Figure 19:
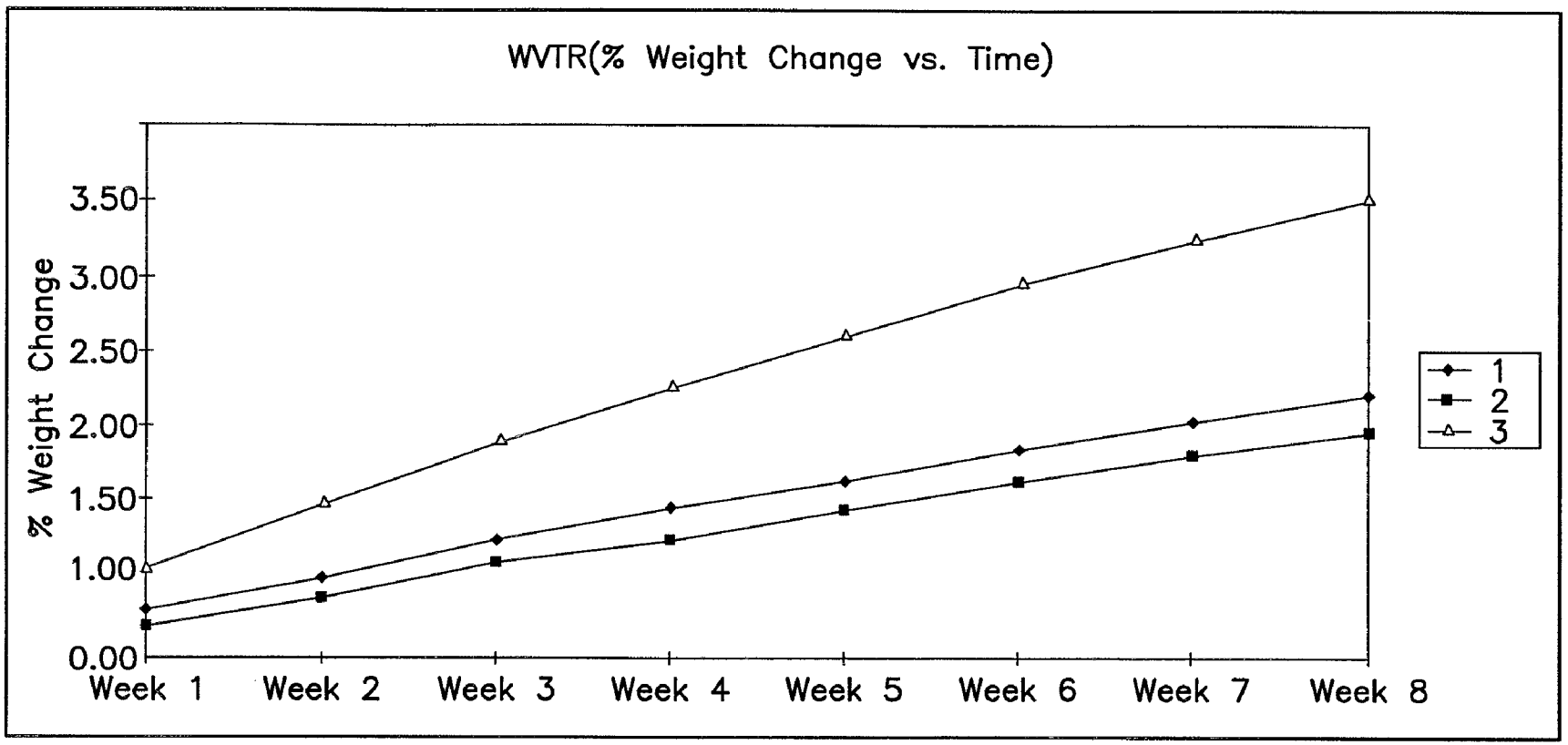
FIG. 19 is a graph showing the water vapor transmission rate, the percentage of weight change over time.

As shown in Table 1 and in FIG. 19, which is a graph representation of the data shown in Table 1, the Product Packaging 2 provided the best moisture barrier. After approximately 3 weeks, the products contained in the Product Packaging 2 began to yellow in appearance and continued to yellow over the 8-week period. Coloration data was not available for the other two product packages.

EXAMPLE 2

Testing was conducted to determine weight loss and weight gain in solid acid and alkaline products over a period of eight weeks when exposed to ambient conditions (73° F. with a relative humidity of 50%) and accelerated conditions (100° F. with a relative humidity of 65% and 100° F. with a relative humidity of 85%) in several different types of product packaging.

The solid acid product was the product disclosed in U.S. Patent Application Publication No. US 2005/0197276 A1, and the solid alkaline product was the product disclosed in U.S. patent application Ser. No. 11/487,599, titled Alkaline Floor Cleaning Composition and Method of Cleaning a Floor. The acidic solid product disclosed in U.S. Patent Application Publication No. US 2005/0197276 A1 and the alkaline solid product disclosed in U.S. patent application Ser. No. 11/487,599, titled Alkaline Floor Cleaning Composition and Method of Cleaning a Floor are the SOLIDSENSE™ Floor Care A & B products by Ecolab Inc, of St. Paul, Minn.

Packaging A was a semi-rigid vacuum formed tray made of 15 mil polyester/3 mil linear low density polyethylene (WINPAK PETE 37575 L manufactured by WINPAK LTD. of Winnipeg, Manitoba, Canada) with an easy peel lid stock made of 0.8 mil nylon/2.7 mil low density polyethylene (WINPAK PAE 2070 Z14 manufactured by WINPAK LTD. of Winnipeg, Manitoba, Canada).

Packaging B was a semi-rigid vacuum formed tray made of 15 mil polyester/3 mil linear low density polyethylene (WINPAK PETE 37575 L manufactured by WINPAK LTD. of Winnipeg, Manitoba, Canada) with an easy peel lid stock made of 4.0 mil white pigmented high density polyethylene coextrusion (WINPAK SK 100 WNF manufactured by WINPAK LTD. of Winnipeg, Manitoba, Canada).

Packaging C was a semi-rigid vacuum formed tray made of 21 mil polypropylene/3 mil polyethylene coextrusion (WINPAK PE 600 N manufactured by WINPAK LTD. of Winnipeg, Manitoba, Canada) with an easy peel lid stock made of 4.0 mil white pigmented high density polyethylene coextrusion (WINPAK SK 100 WNF manufactured by WINPAK LTD. of Winnipeg, Manitoba, Canada).

Packaging D was a flexible vacuum formed tray made of 9 mil nylon, EVOH, linear low density polyethylene (WINPAK MB 225L manufactured by WINPAK LTD. of Winnipeg, Manitoba, Canada) with an easy peel lid stock made of 0.8 mil nylon/2.7 mil low density polyethylene (WINPAK PAE 2070 Z14 manufactured by WINPAK LTD. of Winnipeg, Manitoba, Canada).

Packaging E was a flexible vacuum formed tray made of 9 mil nylon, EVOH, linear low density polyethylene (WINPAK MB 225L manufactured by WINPAK LTD. of Winnipeg, Manitoba, Canada) with an easy peel lid stock made of 4.0 mil white pigmented high density polyethylene coextrusion (WINPAK SK 100 WNF manufactured by WINPAK LTD. of Winnipeg, Manitoba, Canada).

Packaging F was a flexible vacuum formed tray made of 9.0 mil polypropylene, polyolefin plastomer coextrusion (WINPAK MFS 225 L manufactured by WINPAK LTD. of Winnipeg, Manitoba, Canada) with an easy peel lid stock made of 4.0 mil white pigmented high density polyethylene coextrusion (WINPAK SK 100 WNF manufactured by WINPAK LTD. of Winnipeg, Manitoba, Canada).

In addition to weight loss and weight gain under ambient and accelerated conditions, visual inspections were conducted to help determine the stability of the solid products under these conditions. The solid products were rated each week over 8 weeks using a numerical system. The number 1 represents that there were no discrepancies observed, the number 2 represents that there was no change from the previous week, the number 3 represents that there was a hole in the film, the number 4 represents that the product was discoloring (yellow), and the number 5 represents that the product was becoming soft.

The results of the change in weight for the solid acid product are in Table 2 and for the solid alkaline product are in Table 4. The results of the visual inspection for the solid acid product are in Table 3 and for the solid alkaline product are in Table 5.

TABLE 2

| Weight Change of Solid Acid Product Over Eight Weeks | | | | | | |
|---|---|---|---|---|---|---|
| Conditions | Packaging | Initial Weight (grams) | Week 4 | Week 8 | Total Weight Change | Percentage Weight Change |
| Ambient | B | 1127.10 | 1128.50 | 1129.62 | 2.52 | 0.22 |
| Ambient | C | 1098.80 | 1099.30 | 1099.87 | 1.07 | 0.10 |
| Ambient | E | 1087.90 | 1088.70 | 1089.37 | 1.47 | 0.14 |
| Ambient | F | 1077.90 | 1079.00 | 1079.86 | 1.96 | 0.18 |
| 100° F., 85% RH | B | 1150.00 | 1157.00 | 1161.77 | 11.77 | 1.02 |
| 100° F., 85% RH | C | 1103.60 | 1107.10 | 1109.81 | 6.21 | 0.56 |
| 100° F., 85% RH | E | 1089.50 | 1094.90 | 1098.81 | 9.31 | 0.85 |
| 100° F., 85% RH | F | 1095.00 | 1102.00 | 1106.85 | 11.85 | 1.08 |

TABLE 3

| Visual Inspection Results of the Solid Acid Product Over Eight Weeks | | | | | | | | | |
|---|---|---|---|---|---|---|---|---|---|
| Conditions | Packaging | Week 1 | Week 2 | Week 3 | Week 4 | Week 5 | Week 6 | Week 7 | Week 8 |
| Ambient | B | 1 | 2 | 2 | 2 | 2 | 2 | 2 | 2 |
| Ambient | C | 1 | 2 | 2 | 2 | 2 | 2 | 2 | 2 |

TABLE 3-continued

Visual Inspection Results of the Solid Acid Product Over Eight Weeks

| Conditions | Packaging | Week 1 | Week 2 | Week 3 | Week 4 | Week 5 | Week 6 | Week 7 | Week 8 |
|---|---|---|---|---|---|---|---|---|---|
| Ambient | E | 1 | 2 | 2 | 2 | 2 | 2 | 2 | 2 |
| Ambient | F | 1 | 2 | 2 | 2 | 2 | 2 | 5 bottom edge | 2 |
| 100° F., 85% RH | B | 1 | 2 | 4 | 4 | 4, 5 | 4, 5 | 4, 5 | 4, 5 |
| 100° F., 85% RH | C | 1 | 4 | 2 | 2 | 4, 5 | 4, 5 | 4, 5 | 4, 5 |
| 100° F., 85% RH | E | 1 | 2 | 4 | 4 | 4, 5 | 4, 5 | 4, 5 | 4, 5 |
| 100° F., 85% RH | F | 1 | 4 | 4 | 4 | 4, 5 | 4, 5 | 4, 5 | 4, 5 |

TABLE 4

Weight Change of Solid Alkaline Product Over Eight Weeks

| Conditions | Packaging | Initial Weight (grams) | Week 4 | Week 8 | Total Weight Change | Percentage Weight Change |
|---|---|---|---|---|---|---|
| Ambient | A | 1260.00 | 1261.00 | 1262.03 | 2.03 | 0.16 |
| Ambient | B | 1257.40 | 1258.20 | 1259.09 | 1.69 | 0.13 |
| Ambient | D | 1242.50 | 1243.10 | 1243.73 | 1.23 | 0.10 |
| Ambient | E | 1255.10 | 1255.60 | 1256.18 | 1.08 | 0.09 |
| 100° F., 65% RH | A | 1242.50 | 1248.70 | 1253.60 | 11.10 | 0.89 |
| 100° F., 65% RH | B | 1245.60 | 1253.30 | 1259.22 | 13.62 | 1.09 |
| 100° F., 65% RH | D | 1237.20 | 1241.60 | 1245.26 | 8.06 | 0.65 |
| 100° F., 65% RH | E | 1236.40 | 1240.50 | 1243.63 | 7.23 | 0.58 |
| 100° F., 85% RH | A | 1240.90 | 1248.70 | 1254.87 | 13.97 | 1.13 |
| 100° F., 85% RH | B | 1225.60 | 1233.00 | 1238.68 | 13.08 | 1.07 |
| 100° F., 85% RH | D | 1227.40 | 1234.00 | 1239.32 | 11.92 | 0.97 |
| 100° F., 85% RH | E | 1233.50 | 1238.90 | 1243.12 | 9.62 | 0.78 |

From these results, it was determined that the lower the WVTR of the film, the better protection was provided for the acid and alkaline products. The films providing acceptable protection for the acid and alkaline products had a WVTR of less than 0.02 g/100 sq. in. The films providing unacceptable protection for the acid and alkaline products had WVTR of less than 0.06 to 0.45 g/100 sq. in., at which the integrity of the products deteriorated.

EXAMPLE 3

Testing was conducted to determine weight loss and weight gain in solid acid and alkaline products over a period of eight weeks when exposed to ambient conditions (73° F. with a relative humidity of 50%) and accelerated conditions (100° F. with a relative humidity of 65% and 100° F. with a relative humidity of 85%) in several different types of product packaging.

The solid acid product was the product disclosed in U.S. Patent Application Publication No. US 2005/0197276 A1,

TABLE 5

Visual Inspection Results of the Solid Alkaline Product Over Eight Weeks

| Conditions | Packaging | Week 1 | Week 2 | Week 3 | Week 4 | Week 5 | Week 6 | Week 7 | Week 8 |
|---|---|---|---|---|---|---|---|---|---|
| Ambient | A | 1 | 2 | 2 | 2 | 2 | 2 | 2 | 2 |
| Ambient | B | 1 | 2 | 2 | 2 | 2 | 2 | 2 | 2 |
| Ambient | D | 1 | 2 | 2 | 2 | 2 | 2 | 2 | 2 |
| Ambient | E | 1 | 2 | 2 | 2 | 2 | 2 | 2 | 2 |
| 100° F., 65% RH | A | 1 | 2 | 2 | 2 | 5 | 5 | 5 | 5 |
| 100° F., 65% RH | B | 1 | 2 | 3[1] | 2 | 5 | 5 | 5 | 5 |
| 100° F., 65% RH | D | 1 | 2 | 2 | 2 | 5 | 5 | 5 | 5 |
| 100° F., 65% RH | E | 1 | 2 | 2 | 2 | 5 | 5 | 5 | 5 |
| 100° F., 85% RH | A | 1 | 2 | 2 | 2 | 5 | 5 | 5 | 5 |
| 100° F., 85% RH | B | 1 | 2 | 2 | 2 | 5 | 5 | 5 | 5 |
| 100° F., 85% RH | D | 3[2] | 2 | 2 | 5 | 5 | 5 | 5 | 5 |
| 100° F., 85% RH | E | 1 | 2 | 2 | 5 | 5 | 5 | 5 | 5 |

[1]tear caused by handling

[2]package was damaged and the solid alkaline product was the product disclosed in U.S. patent application Ser. No. 11/487,599, titled Alkaline Floor Cleaning Composition and Method of Cleaning a Floor. The acidic solid product disclosed in U.S. Patent Application Publication No. US 2005/0197276 A1 and the alkaline solid product disclosed in U.S. patent application Ser. No. 11/487,599, titled Alkaline Floor Cleaning Composition and Method of Cleaning a Floor are the SOLIDSENSE™ Floor Care A & B products by Ecolab Inc, of St. Paul, Minn.

Packaging G was a semi-rigid vacuum formed tray made of 15 mil polyester/3 mil linear low density polyethylene (WINPAK PETE 37575 L with a WVTR of 0.06 g/100 sq. in. manufactured by WINPAK LTD. of Winnipeg, Manitoba, Canada) with an easy peel lid stock made of 0.8 mil nylon/2.7 mil low density polyethylene/easy peel (WINPAK PAE 2070 Z14 with a WVTR of 0.45 g/100 sq. in. manufactured by WINPAK LTD. of Winnipeg, Manitoba, Canada).

Packaging H was a flexible shrink film made of multi-layered, cross-linked polyethylene shrink film, single wound, 1.25 mil manufactured by Cryovac, Inc. of Saddle Brook, N.J.

In addition to weight loss and weight gain under ambient and accelerated conditions, visual inspections were conducted to help determine the stability of the solid products under these conditions. The solid products were rated each week over 8 weeks using a numerical system. The number 1 represents that there were no discrepancies observed, the number 2 represents that there was no change from the previous week, the number 3 represents that there was tearing in the film, the number 4 represents that the product was becoming soft, the number 5 represents that the product was discoloring, the number 6 represents that the product was discolored, and the number 7 represents that slight mold patches were beginning to form.

The results of the change in weight for the solid acid product are in Table 6 and for the solid alkaline product are in Table 8. The results of the visual inspection for the solid acid product are in Table 7 and for the solid alkaline product are in Table 9.

TABLE 6

Weight Change of Solid Acid Product Over Eight Weeks

| Conditions | Pkg. | Sample | Initial Weight (grams) | Week 4 | Week 8 | Total Weight Change | Percentage Weight Change |
|---|---|---|---|---|---|---|---|
| Ambient | G | 1 | 1119.06 | 1119.41 | 1119.63 | 0.57 | 0.05 |
| Ambient | G | 2 | 1116.64 | 1116.97 | 1117.13 | 0.49 | 0.04 |
| Ambient | G | 3 | 1118.62 | 1118.85 | 1119.12 | 0.50 | 0.04 |
| Ambient | G | 4 | 1120.17 | 1120.45 | 1120.63 | 0.46 | 0.04 |
| Ambient | H | 1 | 1099.17 | 1100.86 | 1102.03 | 2.86 | 0.26 |
| Ambient | H | 2 | 1090.03 | 1091.70 | 1092.95 | 2.92 | 0.27 |
| Ambient | H | 3 | 1088.23 | 1089.85 | 1091.06 | 2.83 | 0.26 |
| Ambient | H | 4 | 1093.31 | 1094.94 | 1096.16 | 2.85 | 0.26 |
| 100° F., 65% RH | G | 1 | 1128.95 | 1130.28 | 1131.45 | 2.50 | 0.22 |
| 100° F., 65% RH | G | 2 | 1111.16 | 1113.00 | 1115.00 | 3.84 | 0.35 |
| 100° F., 65% RH | G | 3 | 1117.61 | 1118.97 | 1120.18 | 2.57 | 0.23 |
| 100° F., 65% RH | G | 4 | 1114.64 | 1116.29 | 1117.98 | 3.34 | 0.30 |
| 100° F., 65% RH | H | 1 | 1091.19 | 1096.94 | 1101.14 | 9.95 | 0.91 |
| 100° F., 65% RH | H | 2 | 1101.87 | 1107.32 | 1111.76 | 9.89 | 0.90 |
| 100° F., 65% RH | H | 3 | 1098.43 | 1105.37 | 1110.76 | 12.33 | 1.12 |
| 100° F., 65% RH | H | 4 | 1096.20 | 1102.52 | 1107.08 | 10.88 | 0.99 |
| 100° F., 85% RH | G | 1 | 1112.21 | 1113.79 | 1115.98 | 3.77 | 0.34 |
| 100° F., 85% RH | G | 2 | 1120.96 | 1131.55 | 1133.82 | 12.86 | 1.15 |
| 100° F., 85% RH | G | 3 | 1113.88 | 1117.78 | 1121.80 | 7.92 | 0.71 |
| 100° F., 85% RH | G | 4 | 1109.62 | 1111.99 | 1114.16 | 4.54 | 0.41 |
| 100° F., 85% RH | H | 1 | 1099.03 | 1112.95 | 1125.19 | 26.16 | 2.38 |
| 100° F., 85% RH | H | 2 | 1103.50 | 1116.29 | 1127.11 | 23.61 | 2.14 |
| 100° F., 85% RH | H | 3 | 1096.66 | 1110.49 | 1121.45 | 24.79 | 2.26 |
| 100° F., 85% RH | H | 4 | 1090.39 | 1100.65 | 1110.46 | 20.07 | 1.84 |

TABLE 7

Visual Inspection Results of the Solid Acid Product Over Eight Weeks

| Conditions | Packaging/ Sample | Week 1 | Week 2 | Week 3 | Week 4 | Week 5 | Week 6 | Week 7 | Week 8 |
|---|---|---|---|---|---|---|---|---|---|
| Ambient | G/1 | 1 | 2 | 2 | 2 | 2 | 2 | 2 | 2 |
| Ambient | G/2 | 1 | 2 | 2 | 2 | 2 | 2 | 2 | 2 |
| Ambient | G/3 | 1 | 2 | 2 | 2 | 2 | 2 | 2 | 2 |
| Ambient | G/4 | 1 | 2 | 2 | 2 | 2 | 2 | 2 | 2 |
| Ambient | H/1 | 1 | 2 | 2 | 4 | 2 | 2 | 2 | 2 |
| Ambient | H/2 | 1 | 2 | 4 | 2 | 5 | 2 | 2 | 2 |
| Ambient | H/3 | 1 | 2 | 4 | 2 | 2 | 2 | 2 | 2 |
| Ambient | H/4 | 1 | 2 | 2 | 4 | 2 | 2 | 2 | 2 |
| 100° F., 65% RH | G/1 | 1 | 2 | 4 | 2 | 2 | 2 | 2 | 2 |
| 100° F., 65% RH | G/2 | 1 | 2 | 4 | 2 | 2 | 2 | 2 | 2 |
| 100° F., 65% RH | G/3 | 1 | 2 | 4 | 2 | 2 | 2 | 2 | 2 |
| 100° F., 65% RH | G/4 | 1 | 2 | 4 | 2 | 5 | 2 | 2 | 2 |
| 100° F., 65% RH | H/1 | 4, 5 | 2 | 2 | 2 | 2 | 2 | 2 | 2 |
| 100° F., 65% RH | H/2 | 4, 5 | 2 | 2 | 2 | 2 | 2 | 2 | 2 |
| 100° F., 65% RH | H/3 | 3, 4, 5 | 2 | 2 | 2 | 2 | 2 | 2 | 2 |
| 100° F., 65% RH | H/4 | 4, 5 | 2 | 2 | 2 | 2 | 2 | 2 | 2 |
| 100° F., 85% RH | G/1 | 1 | 4 | 2 | 2 | 2 | 2 | 2 | 2 |
| 100° F., 85% RH | G/2 | 1 | 4, 5 | 2 | 2 | 2 | 2 | 2 | 2 |
| 100° F., 85% RH | G/3 | 1 | 4 | 2 | 5 | 2 | 2 | 2 | 2 |
| 100° F., 85% RH | G/4 | 1 | 4 | 2 | 2 | 2 | 2 | 2 | 5 |
| 100° F., 85% RH | H/1 | 4, 5 | 2 | 2 | 2 | 2 | 2 | 2 | 2 |
| 100° F., 85% RH | H/2 | 4, 5 | 3 | 2 | 2 | 2 | 2 | 2 | 2 |
| 100° F., 85% RH | H/3 | 4, 5 | 2 | 2 | 2 | 2 | 2 | 2 | 2 |
| 100° F., 85% RH | H/4 | 4, 5 | 2 | 2 | 2 | 2 | 2 | 2 | 2 |

40

TABLE 8

Weight Change of Solid Alkaline Product Over Eight Weeks

| Conditions | Pkg. | Sample | Initial Weight (grams) | Week 4 | Week 8 | Total Weight Change | Percentage Weight Change |
|---|---|---|---|---|---|---|---|
| Ambient | G | 1 | 1148.65 | 1148.86 | 1148.98 | 0.33 | 0.03 |
| Ambient | G | 2 | 1144.95 | 1145.14 | 1145.28 | 0.33 | 0.03 |
| Ambient | G | 3 | 1152.76 | 1152.98 | 1153.12 | 0.36 | 0.03 |
| Ambient | G | 4 | 1149.80 | 1150.30 | 1150.68 | 0.88 | 0.08 |
| Ambient | H | 1 | 1125.57 | 1127.66 | 1129.00 | 3.43 | 0.30 |
| Ambient | H | 2 | 1117.30 | 1119.18 | 1120.30 | 3.00 | 0.27 |
| Ambient | H | 3 | 1128.05 | 1129.93 | 1131.22 | 3.17 | 0.28 |
| Ambient | H | 4 | 1133.85 | 1135.64 | 1136.92 | 3.07 | 0.27 |
| 100° F., 65% RH | G | 1 | 1142.92 | 1144.33 | 1145.41 | 2.49 | 0.22 |
| 100° F., 65% RH | G | 2 | 1143.59 | 1145.24 | 1146.30 | 2.71 | 0.24 |
| 100° F., 65% RH | G | 3 | 1148.00 | 1152.34 | 1153.26 | 5.26 | 0.46 |
| 100° F., 65% RH | G | 4 | 1130.44 | 1132.35 | 1133.37 | 2.93 | 0.26 |
| 100° F., 65% RH | H | 1 | 1061.10 | 1068.38 | 1074.65 | 13.55 | 1.28 |
| 100° F., 65% RH | H | 2 | 1068.07 | 1078.63 | 1083.45 | 15.38 | 1.44 |
| 100° F., 65% RH | H | 3 | 1127.08 | 1134.73 | 1140.84 | 13.76 | 1.22 |

TABLE 8-continued

Weight Change of Solid Alkaline Product Over Eight Weeks

| Conditions | Pkg. | Sample | Initial Weight (grams) | Week 4 | Week 8 | Total Weight Change | Percentage Weight Change |
|---|---|---|---|---|---|---|---|
| 100° F., 65% RH | H | 4 | 1136.93 | 1159.92 | 1165.15 | 28.22 | 2.48 |
| 100° F., 85% RH | G | 1 | 1147.85 | 1149.82 | 1151.50 | 3.65 | 0.32 |
| 100° F., 85% RH | G | 2 | 1142.47 | 1145.18 | 1148.37 | 5.90 | 0.52 |
| 100° F., 85% RH | G | 3 | 1137.91 | 1140.50 | 1142.46 | 4.55 | 0.40 |
| 100° F., 85% RH | G | 4 | 1132.36 | 1135.48 | 1137.89 | 5.53 | 0.49 |
| 100° F., 85% RH | H | 1 | 1138.11 | 1152.12 | 1164.40 | 26.29 | 2.31 |
| 100° F., 85% RH | H | 2 | 1125.72 | 1140.80 | 1153.99 | 28.27 | 2.51 |
| 100° F., 85% RH | H | 3 | 1126.95 | 1142.40 | 1157.47 | 30.52 | 2.71 |
| 100° F., 85% RH | H | 4 | 1068.28 | 1078.24 | 1092.91 | 24.63 | 2.31 |

TABLE 9

Visual Inspection Results of the Solid Alkaline Product Over Eight Weeks

| Conditions | Packaging/ Sample | Week 1 | Week 2 | Week 3 | Week 4 | Week 5 | Week 6 | Week 7 | Week 8 |
|---|---|---|---|---|---|---|---|---|---|
| Ambient | G/1 | 1 | 2 | 2 | 2 | 2 | 2 | 2 | 2 |
| Ambient | G/2 | 1 | 2 | 2 | 2 | 2 | 2 | 2 | 2 |
| Ambient | G/3 | 1 | 2 | 2 | 2 | 2 | 2 | 2 | 2 |
| Ambient | G/4 | 1 | 2 | 2 | 2 | 2 | 2 | 2 | 2 |
| Ambient | H/1 | 3 | 4 | 2 | 2 | 2 | 2 | 2 | 2 |
| Ambient | H/2 | 1 | 3 | 2 | 4 | 2 | 2 | 2 | 2 |
| Ambient | H/3 | 1 | 1 | 2 | 4 | 2 | 2 | 2 | 7 |
| Ambient | H/4 | 1 | 1 | 2 | 4 | 2 | 2 | 2 | 2 |
| 100° F., 65% RH | G/1 | 1 | 2 | 2 | 4 | 2 | 2 | 2 | 2 |
| 100° F., 65% RH | G/2 | 1 | 2 | 2 | 4 | 2 | 2 | 2 | 2 |
| 100° F., 65% RH | G/3 | 1 | 4 | 2 | 2 | 2 | 2 | 2 | 2 |
| 100° F., 65% RH | G/4 | 1 | 2 | 2 | 4 | 2 | 2 | 2 | 2 |
| 100° F., 65% RH | H/1 | 4 | 2 | 2 | 2 | 2 | 2 | 2 | 2 |
| 100° F., 65% RH | H/2 | 4 | 2 | 2 | 2 | 2 | 2 | 2 | 2 |
| 100° F., 65% RH | H/3 | 4 | 2 | 2 | 2 | 2 | 2 | 2 | 2 |
| 100° F., 65% RH | H/4 | 3, 4 | 2 | 2 | 2 | 2 | 5 | 2 | 2 |
| 100° F., 85% RH | G/1 | 1 | 2 | 2 | 4 | 2 | 2 | 2 | 2 |
| 100° F., 85% RH | G/2 | 1 | 2 | 2 | 4 | 2 | 2 | 2 | 2 |
| 100° F., 85% RH | G/3 | 1 | 2 | 2 | 4 | 2 | 2 | 2 | 2 |
| 100° F., 85% RH | G/4 | 1 | 2 | 2 | 4 | 2 | 2 | 2 | 2 |
| 100° F., 85% RH | H/1 | 4 | 2 | 2 | 2 | 2 | 2 | 2 | 2 |
| 100° F., 85% RH | H/2 | 3, 4 | 2 | 2 | 2 | 2 | 2 | 2 | 2 |
| 100° F., 85% RH | H/3 | 3, 4 | 2 | 2 | 2 | 5 | 2 | 2 | 2 |
| 100° F., 85% RH | H/4 | 3, 4 | 2 | 2 | 2 | 5 | 2 | 6 | 2 |

Both the solid acid products and the solid alkaline products packaged in the semi-rigid trays showed a significant reduction in weight gain as compared to the solid acid products and the solid alkaline products packaged in the flexible shrink film. Further, the appearance of the solid acid products and the solid alkaline products packaged in the semi-rigid trays were acceptable while the solid acid products and the solid alkaline products packaged in the flexible shrink film had a mottled appearance.

For Packaging G, the base had a WVTR of 0.06 g/100 sq. in. and the lid had a WVTR of 0.45 g/100 sq. in.

EXAMPLE 4

Testing was conducted to determine weight loss and weight gain in solid acid and alkaline products over a period of eight weeks when exposed to ambient conditions (73° F. with a relative humidity of 50%) and accelerated conditions (100° F. with a relative humidity of 85%) in several different types of product packaging.

The solid acid product was the product disclosed in U.S. Patent Application Publication No. US 2005/0197276 A1, and the solid alkaline product was the product disclosed in U.S. patent application Ser. No. 11/487,599, titled Alkaline Floor Cleaning Composition and Method of Cleaning a Floor. The acidic solid product disclosed in U.S. Patent Application Publication No. US 2005/0197276 A1 and the alkaline solid product disclosed in U.S. patent application Ser. No. 11/487,599, titled Alkaline Floor Cleaning Composition and Method of Cleaning a Floor are the SOLIDSENSE™ Floor Care A & B products by Ecolab Inc, of St. Paul, Minn.

Packaging I was a semi-rigid vacuum formed tray made of 15 mil polyester/3 mil linear low density polyethylene (WINPAK PETE 37575 manufactured by WINPAK LTD. of Winnipeg, Manitoba, Canada) with an easy peel lid stock made of 1 mil nylon/3 mil polyethylene coextrusion (WINPAK PE manufactured by WINPAK LTD. of Winnipeg, Manitoba, Canada).

Packaging J was a flexible shrink film made of multi-layered, cross-linked polyethylene shrink film, single wound, 1.25 mil manufactured by Cryovac, Inc. of Saddle Brook, N.J.

In addition to weight loss and weight gain under ambient and accelerated conditions, visual inspections were conducted to help determine the stability of the solid products under these conditions. The solid products were rated each week over 8 weeks using a numerical system. The number 1 represents that there were no discrepancies observed, the number 2 represents that there was no change from the previous week, the number 3 represents that there was product discoloration and weepage proximate the perforation holes, the number 4 represents that there was product discoloration proximate the film pressure points, the number 5 represents that there was product softening proximate the perforation holes, and the number 6 represents that there was product discoloration proximate the perforation holes.

The results of the change in weight for the solid acid product are in Table 10 and for the solid alkaline product are in Table 12. The results of the visual inspection for the solid acid product are in Table 11 and for the solid alkaline product are in Table 13.

TABLE 10

Weight Change in Product Packaged in Shrink Film Over Eight Weeks

| Conditions | Sample | Initial Weight (grams) | Week 4 | Week 8 | Total Weight Change | Percentage Weight Change |
|---|---|---|---|---|---|---|
| Ambient | 1 | 999.64 | 1000.13 | 1000.62 | 0.98 | 0.10 |
| Ambient | 2 | 1004.72 | 1005.27 | 1005.85 | 1.13 | 0.11 |
| Ambient | 3 | 987.78 | 988.44 | 989.06 | 1.28 | 0.13 |
| Ambient | 4 | 999.89 | 1000.59 | 1001.23 | 1.34 | 0.13 |
| 100° F., 85% RH | 1 | 1028.89 | 1040.62 | 1051.69 | 22.80 | 2.22 |
| 100° F., 85% RH | 2 | 993.37 | 1004.54 | 1016.15 | 22.78 | 2.29 |
| 100° F., 85% RH | 3 | 993.98 | 1004.88 | 1015.93 | 21.95 | 2.21 |
| 100° F., 85% RH | 4 | 1012.31 | 1023.48 | 1034.50 | 22.19 | 2.19 |

TABLE 11

Visual Inspection Results of Product Packaged in Shrink Film Over Eight Weeks

| Conditions | Sample | Week 1 | Week 2 | Week 3 | Week 4 | Week 5 | Week 6 | Week 7 | Week 8 |
|---|---|---|---|---|---|---|---|---|---|
| Ambient | 1 | 4 | 2 | 2 | 2 | 6 | 2 | 2 | 2 |
| Ambient | 2 | 4 | 2 | 2 | 2 | 6 | 2 | 2 | 2 |
| Ambient | 3 | 4 | 2 | 2 | 2 | 6 | 2 | 2 | 2 |
| Ambient | 4 | 4 | 2 | 2 | 2 | 2 | 2 | 2 | 2 |
| 100° F., 85% RH | 1 | 3, 4 | 3, 4, 5 | 2 | 2 | 2 | 2 | 2 | 2 |
| 100° F., 85% RH | 2 | 3, 4 | 3, 4, 5 | 2 | 2 | 2 | 2 | 2 | 2 |
| 100° F., 85% RH | 3 | 3, 4 | 3, 4, 5 | 2 | 2 | 2 | 2 | 2 | 2 |
| 100° F., 85% RH | 4 | 3, 4 | 3, 4, 5 | 2 | 2 | 2 | 2 | 2 | 2 |

TABLE 12

Weight Change in Product Packaged in Tray Over Eight Weeks

| Conditions | Sample | Initial Weight (grams) | Week 4 | Week 8 | Total Weight Change | Percentage Weight Change |
|---|---|---|---|---|---|---|
| Ambient | 1 | 1011.95 | 1012.45 | 1012.88 | 0.93 | 0.09 |
| Ambient | 2 | 1021.66 | 1022.22 | 1022.70 | 1.04 | 0.10 |
| Ambient | 3 | 1010.86 | 1011.37 | 1011.81 | 0.95 | 0.09 |
| Ambient | 4 | 1019.63 | 1020.15 | 1020.59 | 0.96 | 0.09 |
| 100° F., 85% RH | 1 | 992.89 | 998.60 | 1003.72 | 10.83 | 1.09 |

TABLE 12-continued

Weight Change in Product Packaged in Tray Over Eight Weeks

| Conditions | Sample | Initial Weight (grams) | Week 4 | Week 8 | Total Weight Change | Percentage Weight Change |
|---|---|---|---|---|---|---|
| 100° F., 85% RH | 2 | 1016.14 | 1021.36 | 1026.03 | 9.89 | 0.97 |
| 100° F., 85% RH | 3 | 1013.60 | 1018.77 | 1023.49 | 9.89 | 0.98 |
| 100° F., 85% RH | 4 | 1010.98 | 1017.27 | 1022.96 | 11.98 | 1.18 |

TABLE 13

Visual Inspection Results of Product Packaged in Tray Over Eight Weeks

| Conditions | Sample | Week 1 | Week 2 | Week 3 | Week 4 | Week 5 | Week 6 | Week 7 | Week 8 |
|---|---|---|---|---|---|---|---|---|---|
| Ambient | 1 | 3 | 2 | 2 | 2 | 2 | 2 | 2 | 2 |
| Ambient | 2 | 3 | 2 | 2 | 2 | 2 | 2 | 2 | 2 |
| Ambient | 3 | 3 | 2 | 2 | 2 | 2 | 2 | 2 | 2 |
| Ambient | 4 | 3 | 2 | 2 | 2 | 2 | 2 | 2 | 2 |
| 100° F., 85% RH | 1 | 3 | 2 | 2 | 2 | 4 | 2 | 2 | 2 |
| 100° F., 85% RH | 2 | 3 | 2 | 2 | 2 | 4 | 2 | 2 | 2 |
| 100° F., 85% RH | 3 | 3 | 2 | 2 | 2 | 4 | 2 | 2 | 2 |
| 100° F., 85% RH | 4 | 3 | 2 | 2 | 2 | 4 | 2 | 2 | 2 |

For the shrink wrapped blocks, no significant changes were noticeable under ambient conditions. The blocks retained a lot of moisture, were soft, and changed in color in areas where moisture was absorbed under the accelerated conditions. The shrink wrapped blocks did not provide an acceptable moisture barrier. The nature of shrink films requires that there be a process for the evacuation of air as the film shrinks around the product being encased. The two options for air evacuation typically used are punched holes or pin perforations in the film. Both options leave an exposed area of product to atmospheric conditions, specifically moisture uptake, the rate of which can be controlled by the size of the evacuation holes or perforations, but not less than 0.02 g/100 sq. in. as provided by the base portion of the tray packages referenced earlier. The base portion of the tray packages reduces the amount of moisture uptake by the product.

For the tray packages, no significant changes were noticeable under ambient conditions. The blocks retained their firmness under the accelerated conditions. The tray packages provided an acceptable moisture barrier.

Through the series of testing, various materials were evaluated for their ability to maintain the integrity of the packaged products based on moisture gain, product appearance such as discoloration, deformation, and the like. In evaluating different polymers such as nylons, polyethelenes, polypropylenes, and the like, it was determined that a polypropylene coextrusion provided the most desirable results. In addition to having acceptable WVTR rates, polypropylene provides good clarity and has a higher softening point allowing for use with various forming methods known in the art. Although polypropylene provided the most desirable results, it is recognized that other materials also provided acceptable results.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method of dispensing a solid product from a product packaging into a solid product dispenser, the solid product having a first shape, comprising:

a) obtaining a product packaging having a base, a lid, and a seal, the base having a second shape, the base having a top, sides, and a bottom forming a cavity configured and arranged to receive the solid product, the second shape being larger than the first shape and the cavity having a larger size than the solid product so that there is a space between the sides of the base and the solid product, the seal interconnecting the top of the base and the lid, the seal allowing the lid to be grasped and peeled to separate the lid from the top of the base;

b) grasping a portion of the peelable lid;

c) peeling the peelable lid away from the base;

d) holding the base about a texture that extends outward relative to the sides of the base and inverting the base so that the bottom of the base is in an upward orientation and the top of the base is in a downward orientation; and e) allowing the solid product to slide out of the cavity into the solid product dispenser.

2. The method of claim 1, wherein the texture provides a grippable surface.

3. The method of claim 1, wherein the texture is ribbing.

4. The method of claim 3, wherein the ribbing extends outward at least 1.5 mm.

5. The method of claim 3, the ribbing comprising at least first and second ribs, a center of the first rib spaced at least 25.4 mm from a center of the second rib.

6. The method of claim 3, wherein the ribbing is proximate the bottom of the base.

7. The method of claim 1, further comprising squeezing the base thus deflecting the base inward to provide friction between the base and the solid product prior to inverting the base so that the solid product does not fall out of the base until the friction is released.

8. A method of dispensing a solid product from a product packaging into a solid product dispenser, the solid product having a first shape, the product packaging having a base, a lid, and a seal, the base having a second shape, the base having a top, sides, and a bottom forming a cavity configured and arranged to receive the solid product, the second shape being larger than the first shape and the cavity having a larger size than the solid product so that there is a space between the sides of the base and the solid product, the base having an exterior surface with a texture on at least a portion of the exterior surface, the seal interconnecting the top of the base and the lid, the seal allowing the lid to be grasped and peeled to separate the lid from the top of the base, comprising:

a) obtaining the product packaging;

b) grasping a portion of the peelable lid;

c) peeling the peelable lid away from the base;

d) holding the base proximate the texture, the texture providing a grippable surface proximate the exterior surface of the base, at least a portion of the texture being positioned parallel with a bottom of the base;

e) squeezing the base proximate the texture thus deflecting the base inward to provide friction between the base and the solid product prior to inverting the base so that the solid product does not fall out of the base until the friction is released;

f) inverting the base so that the bottom of the base is in an upward orientation and the top of the base is in a downward orientation, the texture enhancing a user's ability to grip the base when the base is inverted; and g) releasing the friction thereby allowing the solid product to slide out of the cavity into the solid product dispenser.

9. The method of claim 8, wherein the texture is ribbing proximate the bottom of the base.

10. The method of claim 9, wherein the ribbing extends outward at least 1.5 mm.

11. The method of claim 9, the ribbing comprising at least first and second ribs, a center of the first rib spaced at least 25.4 mm from a center of the second rib.

* * * * *